United States Patent [19]

Harmon

[11] 4,138,970

[45] Feb. 13, 1979

[54] APPARATUS FOR PRODUCING AN AIR AND LIQUID VAPOR MIXTURE

[76] Inventor: Fred L. Harmon, 7808 Jefferson, Kansas City, Mo. 64114

[21] Appl. No.: 732,590

[22] Filed: Oct. 15, 1976

[51] Int. Cl.[2] ..... F02D 19/00

[52] U.S. Cl. ..... 123/25 R; 261/18 A; 261/124

[58] Field of Search ..... 123/25 R, 25 A, 25 L; 261/18 A, DIG. 66, 124

[56] References Cited

U.S. PATENT DOCUMENTS

| | | | |
|---|---|---|---|
| 1,812,231 | 6/1931 | Agnew | 123/25 L |
| 2,073,887 | 3/1937 | Strancke | 123/25 L |
| 2,687,711 | 8/1954 | Chambers | 123/25 A X |
| 2,692,585 | 10/1954 | Dunnigan | 123/25 A |
| 3,537,434 | 11/1970 | Herpin | 123/25 L |
| 3,716,040 | 2/1973 | Herpin | 123/25 R X |
| 3,767,172 | 10/1973 | Mills | 123/25 R X |
| 3,865,907 | 2/1975 | Roch | 123/25 L X |
| 3,875,922 | 4/1975 | Kirmiss | 123/25 R X |
| 4,076,002 | 2/1978 | Mellquist | 123/25 R X |

*Primary Examiner*—Ira S. Lazarus

*Attorney, Agent, or Firm*—Cushman, Darby & Cushman

[57] ABSTRACT

An apparatus for producing an air and liquid vapor mixture for connection into a fuel inlet stream of an internal combustion engine comprising a glass container having an open top through which liquid to be vaporized can be supplied to the container and a cap removably covering the open top of the container and providing a vacuum tight seal therefor, the cap having a rigid tube carried thereby, one end of which constitutes an exterior air inlet and the other end of which extends to an outlet position adjacent the bottom of the container and has a length of flexible tubing connected therewith which extends in a loop disposed along the container bottom and terminates in an end opening of a size less than the size of the air inlet of the rigid tube. The length of flexible tubing between the ends thereof has a multiplicity of needle punctures extending through the wall thereof and a vacuum line and fitting carried by the cap sealingly communicates with the interior of the container at a position within the space above the free surface of a liquid within the container whereby an engine vacuum in the fuel inlet stream thereof communicated with such space will cause air to be drawn through the air inlet along the rigid tube and into the length of flexible tubing, from which the air passes into the liquid through the needle punctures and end opening and then rises upwardly into the container space in the form of small bubbles.

2 Claims, 3 Drawing Figures

APPARATUS FOR PRODUCING AN AIR AND LIQUID VAPOR MIXTURE

This invention relates to internal combustion engines and more particularly to an apparatus for producing an air and liquid vapor mixture for connection into a fuel inlet stream of an internal combustion engine.

It has been known for many years that the addition of a liquid mist or vapor to the fuel inlet stream of a gasoline engine may have a favorable effect upon the engine performance. This is particularly true when the engine has a tendency to run too hot. Various apparatus have been proposed in the prior art to accomplish this purpose. Examples included in the more recent patent literature include U.S. Pat. Nos. 3,767,172 and No. 3,856,901.

While there have been continuous proposals over the years, to date no extensive utilization of any of the known systems has been made. The present invention is based upon the proposition that the lack of acceptance of the previously proposed apparatus is a result of one or more of the following criteria: too much expense in fabrication; too many adjustments required; or too many mechanical or electrical parts which can malfunction.

Accordingly, it is an object of the present invention to provide an apparatus of the type described which overcomes all of the disadvantages enumerated above in similar apparatus of the prior art previously proposed. In accordance with the principles of the present invention, this objective is obtained by providing an apparatus embodying known standard components which are interrelated in a novel and simple fashion to provide for the effective production of an air and liquid vapor mixture for connection into a fuel inlet stream of an internal combustion engine, which components require no adjustment, are economical to fabricate and assemble and which can be installed without electrical attachments and the like. The apparatus includes a simple clear glass container, such as a conventional one-half gallon jug, a closure for the open top of the container in the form of a standard metal cap having sealingly mounted therein a vacuum fitting for connecting a vacuum line to the space within the container adjacent the cap and above the level of the liquid therein. A rigid tube extends from the cap to the bottom of the container and a length of flexible tubing is connected at one of its ends with the end of the rigid tube and is disposed in looped relation along the bottom of the container. The opposite end of the flexible tubing is provided with an insert which has an end opening formed therein of a size less than the size of the air inlet end of the rigid tube. Between the ends of the length of flexible tubing a multiplicity of needle punctures is provided in the wall thereof. The arrangement insures that when a vacuum line is connected with the vacuum source in the inlet fuel stream of the internal combustion engine, atmospheric air will be drawn through the air inlet along the fixed passageway of the rigid tube to the outlet end thereof from which it enters into the length of flexible tubing. From the flexible tubing the air passes into the liquid within the container through the needle punctures and the end opening and then rises upwardly into the space above the liquid level in the form of small bubbles. This arrangement insures the production of a liquid vapor within the space above the liquid surface which is entrained and mixed with the incoming air, which mixture passes into the vacuum fitting and vacuum line for supply to the fuel inlet stream of the internal combustion engine. The effect of the application of this mixture of air with minute liquid particles of vapor into the fuel inlet stream is to increase the miles per gallon obtained in the performance of the automobile, to reduce the possibility of detonation, and decrease the pollution of the engine exhaust.

The above object and other objects of the present invention will become more apparent during the course of the following detailed description and appended claims.

The invention will best be understood with reference to the accompanying drawings, wherein an illustrative embodiment is shown.

Figure 1:
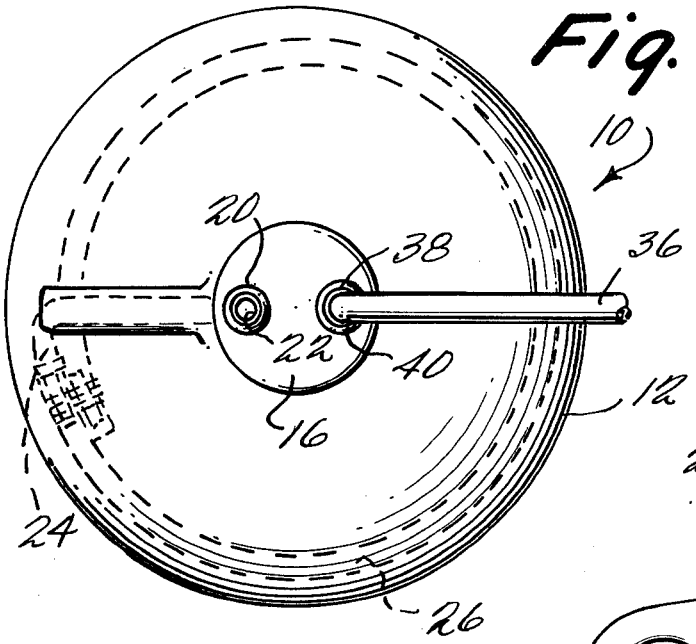
FIG. 1 is a top plan view of an apparatus embodying the principles of the present invention.
Figure 3:
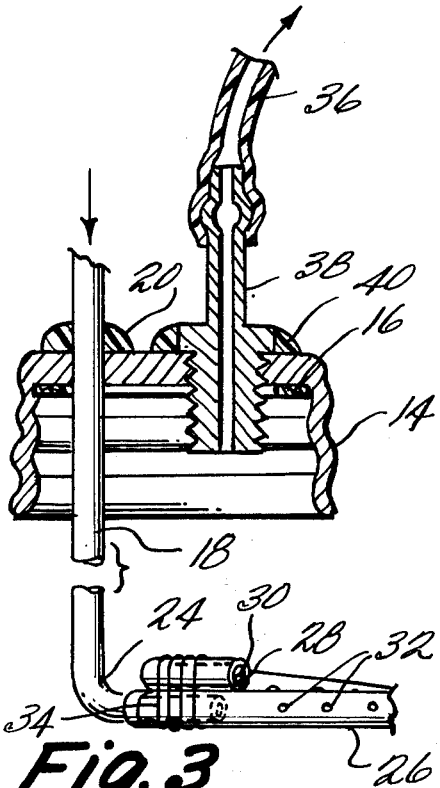
FIG. 3 is an enlarged fragmentary vertical sectional view of the apparatus with the container removed.
Figure 2:
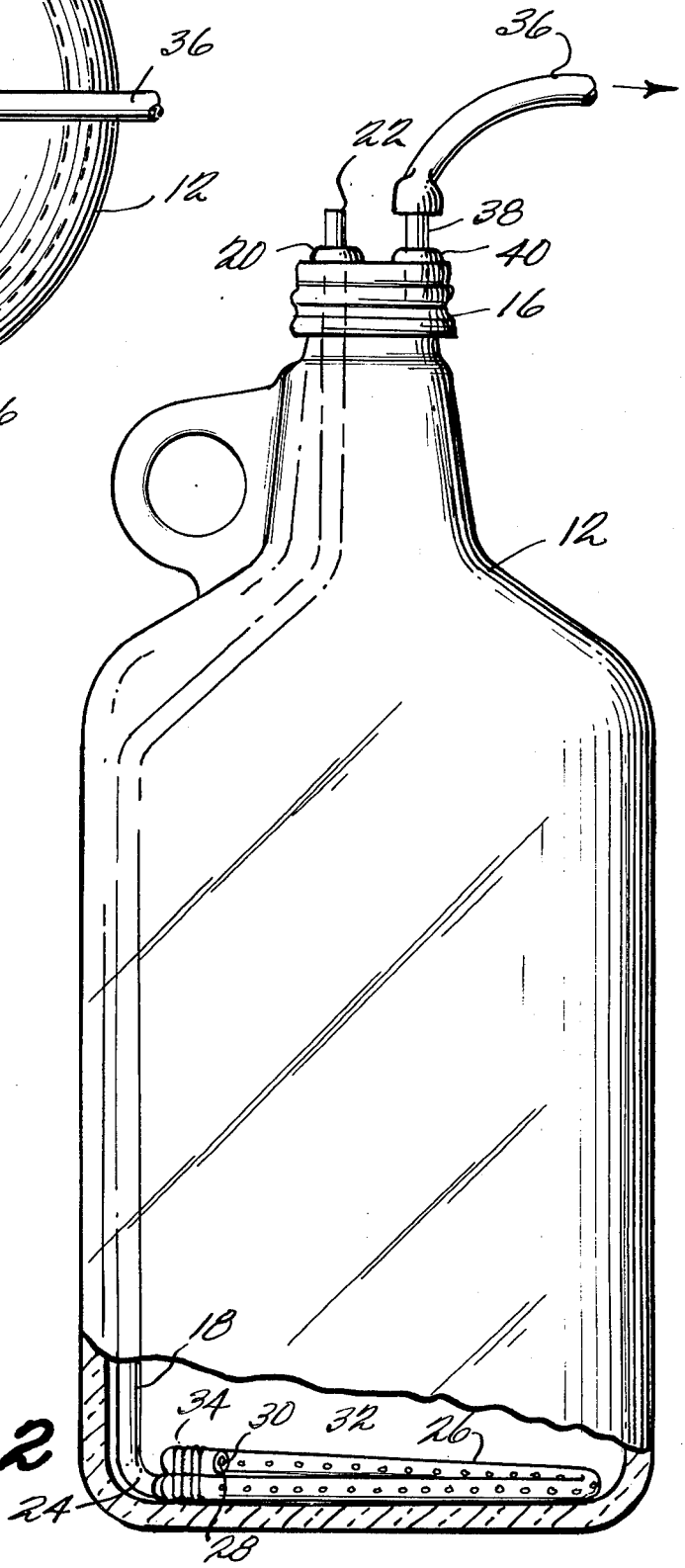
FIG. 2 is a side elevational view of the apparatus shown in FIG. 1 with certain parts broken away for purposes of clearer illustration.

Referring now more particularly to the drawings, there is shown therein an apparatus, generally indicated at 10, for producing an air and liquid vapor mixture for connection into a fuel inlet stream of an internal combustion engine which embodies the principles of the present invention. As best shown in FIGS. 1 and 2, the apparatus 10 includes a rigid wall container 12 having an open top through which a liquid to be vaporized can be supplied to the container. A preferred embodiment of the container 12 is illustrated in the drawings as being in the form of a conventional one-half gallon jug made of clear glass. The preferred container 12 therefore provides for a relatively small open top having integral exterior threads for receiving a conventional threaded cap 14. The cap 14 constitutes a closure member for the container 12 which removably covers the open top of the container and provides a vacuum tight seal for the interior thereof. As best shown in FIG. 3, the cap 14 is of inverted cup-shaped configuration, having a threaded annular skirt of known construction which threadedly engages the exterior threads of the container 12 in a known fashion. A sealing ring 16 is provided within the cap 14 to engage the upper rim of the open top of the container, also in a known fashion.

Carried by the cap 14 is an elongated rigid tube 18. The upper end portion of the tube 18 extends through the circular wall of the cap 14 and is sealed therewith as by a ring 20 of sealing material such as silicone or the like. The upper end of the tube provides an air inlet, indicated at 22, for the apparatus. As best shown in FIG. 2, the rigid tube 18, which is preferably made of copper or the like, extends downwardly within the interior of the container to the bottom thereof and its interior provides a fixed passageway for the flow of air to the bottom of the container. The lower end of the rigid tube 18 is bent at right angles, as indicated at 24. In addition, the tube is suitably bent along its length so that the lower end 24 will be disposed adjacent the periphery of the bottom of the container 12.

Fixed to the lower outlet end 24 of the rigid tube 18 is one end of a length of flexible tubing 26. The length of flexible tubing 26 is fed over the end 24 of the rigid tube 18 and extends in a loop formation disposed along the container bottom. Mounted within the opposite end of the length of tubing 26 is a tubular insert 28 which provides an end opening 30 for the length of flexible tubing 26 which is of a size less than the size of the air inlet 22. In a preferred exemplary embodiment, the end opening 30 is a cylindrical opening having a diameter of 1/16", whereas the inlet opening 22 has a diameter of approximately ⅛". The ⅛" inlet opening is provided by utilizing 3/16" o.d. conventional copper tubing as the rigid tube 18. The length of tubing 26 is preferably formed of nylon material having a 3/16" interior diameter. Formed in the wall of the length of flexible tubing 26 between the ends thereof is a multiplicity of perforations 32 in the form of needle punctures. In the arrangement shown, appproximately 200 such needle punctures are provided in the length of flexible tubing 26. Preferably, the loop formation in the length of flexible tubing 26 is maintained by securing the ends of the tubing together and to the respective elements to which they are secured by wrapping a copper wire 34 about the periphery of each end of the length of flexible tubing as shown in both FIGS. 2 and 3. Preferably, the end of the length of tubing containing the insert 28 is mounted adjacent and above the end connected with the lower outlet end 24 of the rigid tube 18.

For purposes of connecting the apparatus 10 with a vacuum source provided by the fuel inlet stream of an internal combustion engine there is provided a vacuum line 36. The free end of the vacuum line 36 can be conveniently connected with a tee connection in the PVC line provided in conjunction with the internal combustion engines in the more modern automobiles. Where no PVC line is provided, the vacuum line 36 can be connected to the intake manifold at a position downstream of the carburetor. As shown, the vacuum line is in the form of nylon tubing of a 3/16" interior diameter size. The vacuum line 36 is communicated with the interior of the container 12 at a position adjacent the cap 14 within the space above the free surface of the liquid within the container by means of a tubular fitting 38. The fitting 38 extends through the circular wall of the cap 14 and is sealingly secured thereto as by a ring 40 of sealing material, such as silicone or the like. The fitting 38 provides an interior passage of a diameter of 3/16" which communicates at one end to the interior of the container 12 at the position aforesaid and at its other end exteriorly to the adjacent end of the vacuum line 36.

It will be understood that when the vacuum line 36 is connected with the vacuum source of the fuel inlet stream of the internal combustion engine when the latter is in operation, the vacuum line 36 will communicate the vacuum source to the space within the container 12 disposed between the cap 14 and the free surface of the liquid within the container. It will be understood that the liquid is preferably water although a mixture of water and alcohol may be utilized where cold weather conditions are to be encountered. The amount of alcohol utilized is that amount which is sufficient to prevent freezing under the conditions which are to be encountered. While water and antifreeze-water mixture are preferably contemplated, other known liquids may be accommodated as well.

The vacuum conditions which are thus introduced to the interior of the container 12 above the liquid surface level cause the atmospheric pressure acting on the inlet 22 to commence an air flow through the rigid tube 18 and into the length of flexible tubing 26. The insert 28 in the end of the length of flexible tubing 26 restricts the air flow to 1/16" diameter which causes a pressure differential that forces many small air bubbles to pass through the needle punctures in the wall of the length of flexible tubing 26. The air bubbles rise to the water surface and as the bubbles of air burst within the space above the free surface vaporization takes place and this vaporization is carried with the air through fitting 38 and into vacuum line 36. In this way, the apparatus 10 of the present invention serves to produce an air and liquid vapor mixture which is connected with the fuel inlet stream of the internal combustion engine. When in operation, the apparatus will utilize about a quart of water (or water and alcohol mixture) to approximately 16 gallons of gasoline. With the apparatus 10 in operation approximately 5 to 10% saving in fuel is obtained in city driving and approximately 20 to 25% is obtained in highway driving. Pollution problems are decreased by the same percentages as the gasoline mileage economy and detonation knock normally associated with low test gasoline use and advanced ignition timing is eliminated.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. An apparatus for producing an air and liquid vapor mixture for connection into a fuel inlet stream of an internal combustion engine comprising:

a rigid wall container having an open top through which liquid to be vaporized can be supplied to the container;

a closure member removably covering the open top of said container and providing a vacuum tight seal therefor;

a rigid tube carried by said closure member in a position operable when said closure member is in covering relation with said container to provide a fixed imperforate elongated passageway for the flow of atmospheric air from an air inlet position at one end of said tube to an outlet position adjacent the bottom of the container at the other end thereof;

the upper end portion of said rigid tube extending through said closure member and being peripherally fixedly sealed thereto;

said fixed imperforate passageway being of generally constant cross-sectional configuration throughout and devoid of restrictions therein from said one end to said other end;

a length of flexible tubing having one end thereof fixed to the other end of said rigid tube in air flow communicating relation;

said length of flexible tubing extending from the other end of said rigid tube in a loop disposed along the container bottom;

a rigid element inserted in the opposite end of said flexible tubing;

said length of flexible tubing between the ends thereof having a multiplicity of needle punctures extending through the wall thereof;

a vacuum line exterior of said container and said closure member having one end adapted to be connected to a vacuum source provided by the fuel inlet stream of the engine; and means carried by said closure member sealingly communicating the other end of said vacuum line to the interior of said container when said closure member is in covering relation therewith at a position adjacent the closure member within the space above the free surface of a liquid within said container whereby the vacuum communicated with said space will cause air to be drawn through said air inlet along said fixed passageway to the outlet end of said rigid tube and into said length of flexible tubing, from which the air passes into the liquid through said needle punctures and said end opening and then rises upwardly into said space in the form of small bubbles, the ends of said length of flexible tubing being fixedly secured together with said opposite end thereof disposed above said one end thereof by wire wrapped about the periphery of the ends.

2. Apparatus as defined in claim 1 wherein said rigid element inserted in said other end of the length of flexible tubing is tubular.

* * * * *